US006487778B1

(12) United States Patent
Gringer et al.

(10) Patent No.: US 6,487,778 B1
(45) Date of Patent: Dec. 3, 2002

(54) UTILITY KNIFE WITH PRESSURE REDUCING SLOT

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 0 days.

(21) Appl. No.: 09/809,676

(22) Filed: Mar. 15, 2001

(51) Int. Cl.[7] ..... B26B 1/08
(52) U.S. Cl. ..... 30/162; 30/335; 30/2
(58) Field of Search ..... 30/162, 335, 336, 30/2

(56) References Cited

U.S. PATENT DOCUMENTS

| | | | | |
|---|---|---|---|---|
| 5,813,121 A | | 9/1998 | Gringer | 30/162 |
| 6,044,562 A | * | 4/2000 | Dillenbeck | 30/162 |
| 6,058,607 A | | 5/2000 | Gringer | 30/162 |

* cited by examiner

*Primary Examiner*—Douglas D. Watts
(74) *Attorney, Agent, or Firm*—Gottlieb, Rackman & Reisman, P.C.

(57) ABSTRACT

An improved automatically retractable cutting device includes (a) a housing having a guide slot, with one or more notches disposed in the guide slot, (b) a return spring within the housing, and (c) a blade carrier disposed within the housing and biased by the return spring. The blade carrier includes a thumb piece extending through the guide slot, the thumb piece having a protuberance adapted to at least partially frictionally engage the notch during movement of the thumb piece along the guide slot to enable the thumb piece to be held in position adjacent to the notch with reduced force. Each notch may include a forward direction ramping surface, whereby reduced force is required to prevent further blade extension, and/or a reverse direction ramping surface, whereby reduced force is required to prevent blade retraction. Each ramping surface is preferably angled at less than ninety degrees. The housing may be formed by attachable halves, each of which includes notches, whereby the notches are substantially symmetrically aligned when the housing is assembled.

20 Claims, 6 Drawing Sheets

UTILITY KNIFE WITH PRESSURE REDUCING SLOT

BACKGROUND OF THE INVENTION

1. Field of the Invention

The present invention relates generally to an improved automatically retractable utility knife and more particularly to an improved automatically retractable utility knife having a modified blade carrier guide slot that decreases forward pressure on a user's finger during extension of the utility blade.

2. Description of the Related Art

Automatically retractable utility knives, also known as safety knives, are well known in the art, including, for example, commonly owned U.S. Pat. Nos. 6,058,607 and 5,813,121, the contents of which are incorporated by reference herein in their entirety. Automatically retractable utility knives in a rested position feature a blade in a retracted position in a housing. Continuous application of pressure by a user on a thumb piece is required for the blade to remain in the projected position. A spring attached between the housing and a blade carrier automatically retracts the blade upon release of the thumb piece. The spring tension is such that when the blade is projected and inserted in a material being cut, e.g., cardboard, the friction between the blade and the material is generally sufficient to retain the blade in the projected position.

A drawback of this type of utility knife is that it requires constant pressure applied to the thumb piece to cause the blade to remain in the extended position before the cut. Since one object of automatically retractable knives is to retract the blade as quickly as possible to avoid injuring a user, high tension pull springs are frequently used. These springs require even greater continuous pressure on the thumb piece in order for the blade to remain in an exposed position prior to cutting. Through continued use, the user may become fatigued, which may lead to injury.

Accordingly, it would be desirable to have an automatically retractable utility knife with a partial locking mechanism that assists a user in retaining the blade in an extended position but that still permits automatic retraction of the blade.

SUMMARY OF THE INVENTION

The present invention is an improved automatically retractable cutting device having (a) a housing comprising a guide slot, (b) a return spring within the housing, and (c) a blade carrier disposed within the housing and biased by the return spring. The blade carrier includes a thumb piece extending through the guide slot for facilitating movement of the blade carrier in the housing to extend and retract a utility blade. The housing includes at least one notch disposed in the guide slot, and the thumb piece includes a protuberance adapted to at least partially engage the notch during movement of the thumb piece along the guide slot to enable the thumb piece to be held in position adjacent to the notch with reduced force. The protuberance is adapted to frictionally engage the at least one notch. The notch may include a forward direction ramping surface, whereby reduced force is required to prevent further blade extension, and/or a reverse direction ramping surface, whereby reduced force is required to prevent blade retraction.

An alternative improved cutting device includes (a) a housing having a guide slot; and (b) an automatically retractable blade carrier disposed within the housing. The blade carrier comprises a thumb piece extending through the guide slot for facilitating movement of the blade carrier in the housing to extend and retract a utility blade. The guide slot includes one or more notches, each having at least one surface ramped at an angle of less than ninety degrees. The thumb piece is adapted to frictionally engage the at least one notch, preferably by means of a protuberance on the thumb piece.

A further alternative improved cutting device includes a housing having a guide slot, a blade carrier having a thumb piece extending through the guide slot for facilitating movement of the blade carrier in the housing to extend and retract a utility blade, and a return spring within the housing for biasing the blade carrier. A plurality of notches is disposed along a length of the guide slot, and the thumb piece is adapted to frictionally engage each of the plurality of notches in order to decrease user force to maintain extension of the utility blade.

A cutting device according to the invention includes a housing having an upper portion and a lower portion adapted for assembly, a return spring within the housing, and a blade carrier disposed within the housing. The blade carrier is biased by the return spring and includes a thumb piece for facilitating movement of the blade carrier in the housing to extend and retract a utility blade. The housing includes a guide slot formed by the upper portion and lower portion. That portion of the guide slot on the upper portion includes a first set of notches, and that portion of the guide slot on the lower portion includes a second set of notches, with the first and second set of notches being substantially symmetrically aligned when the upper and lower portions of the housing are assembled. The thumb piece frictionally engages at least one of the first and second sets of notches during extension of the blade. If desired, a protuberance may be included on the thumb piece to at least partially engage each notch during movement of the thumb piece.

DETAILED DESCRIPTION OF THE INVENTION

Figures 1, 2, 3:
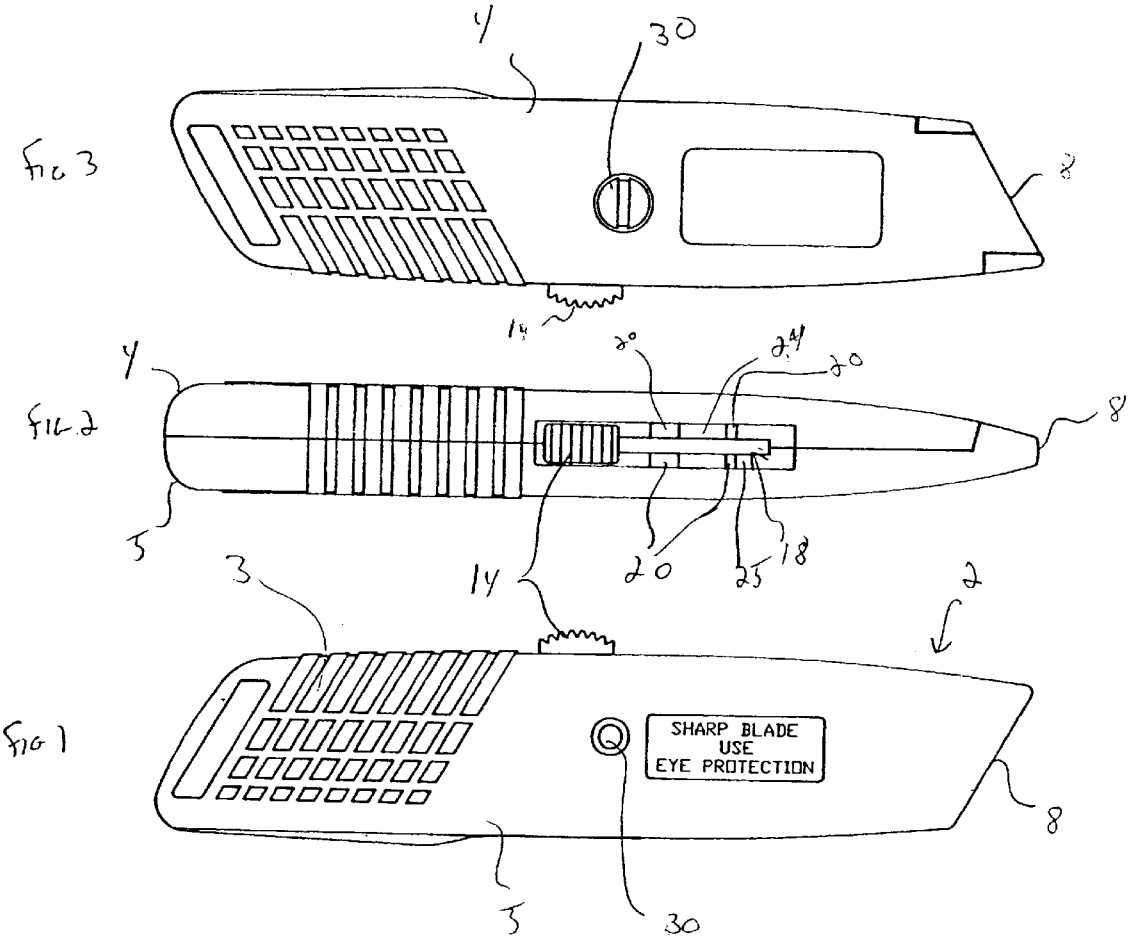
FIG. 1 is a right side view of an automatically retractable utility knife in accordance with the present invention with the blade in the retracted position.
FIG. 2 is a top view of the automatically retractable knife shown in FIG. 1 with the blade in the retracted position.
FIG. 3 is a left side view of the automatically retractable utility knife shown in FIG. 1 with the blade in the retracted position.

As shown in FIGS. 1–6, the present invention is a utility knife 2 having a housing that is constructed of an upper housing portion 4 and a lower housing portion 5 secured by a fastener 30. Both upper and lower housing portions 4 and 5 include support shoulders 24 and 25, respectively. When housing portions 4 and 5 are assembled, support shoulders 24 and 25 define a guide slot 18. A thumb piece 14, which is attached to a blade carrier 12, extends through guide slot 18 so that movement of thumb piece 14 along guide slot 18 by the user causes extension and retraction of a cutting blade 10 (shown in the retracted position in FIGS. 1–4).

Figure 4:
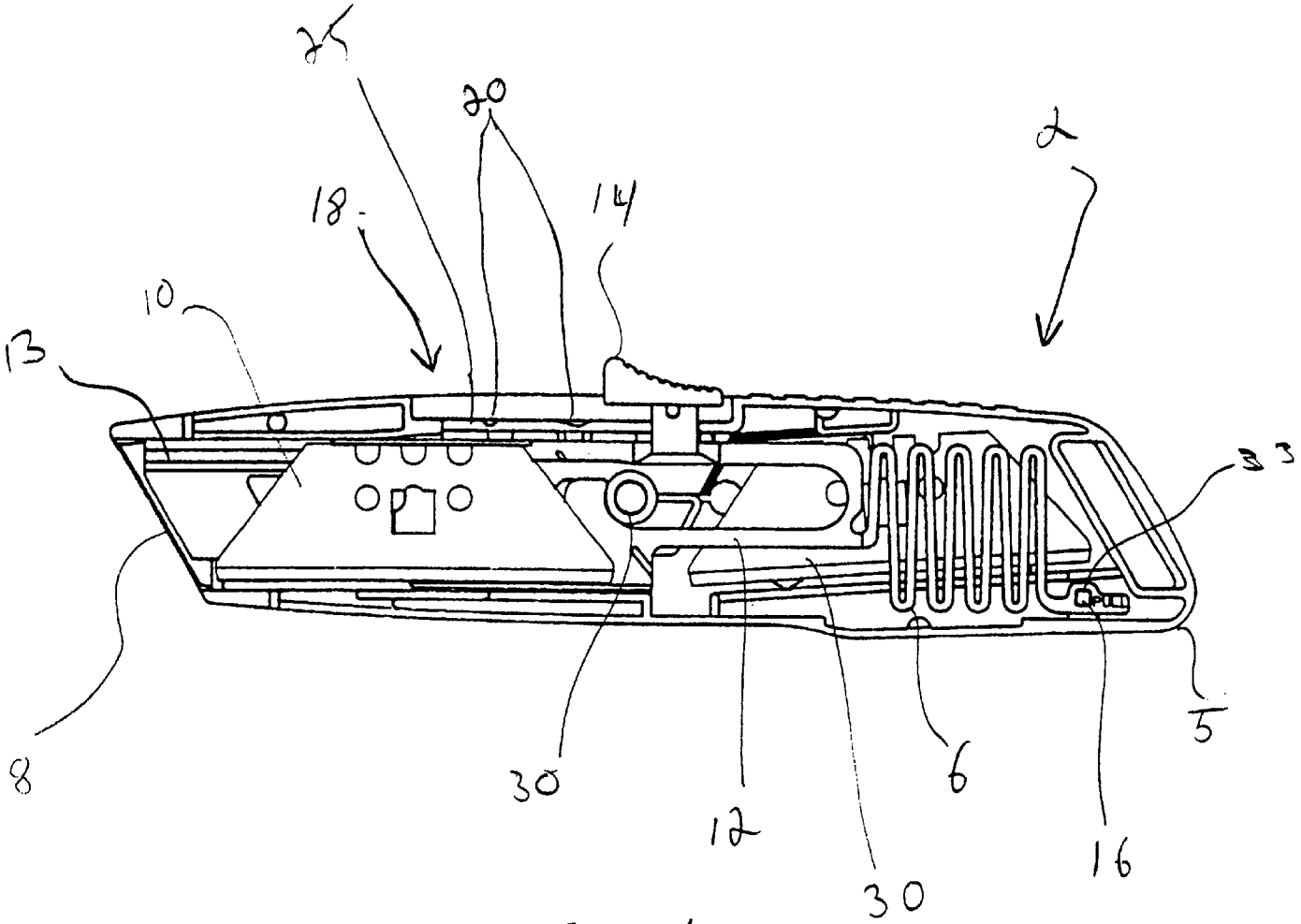
FIG. 4 is a left side view of the automatically retractable utility knife shown in FIG. 1 with the blade in the retracted position and the upper housing removed.
Figure 5:
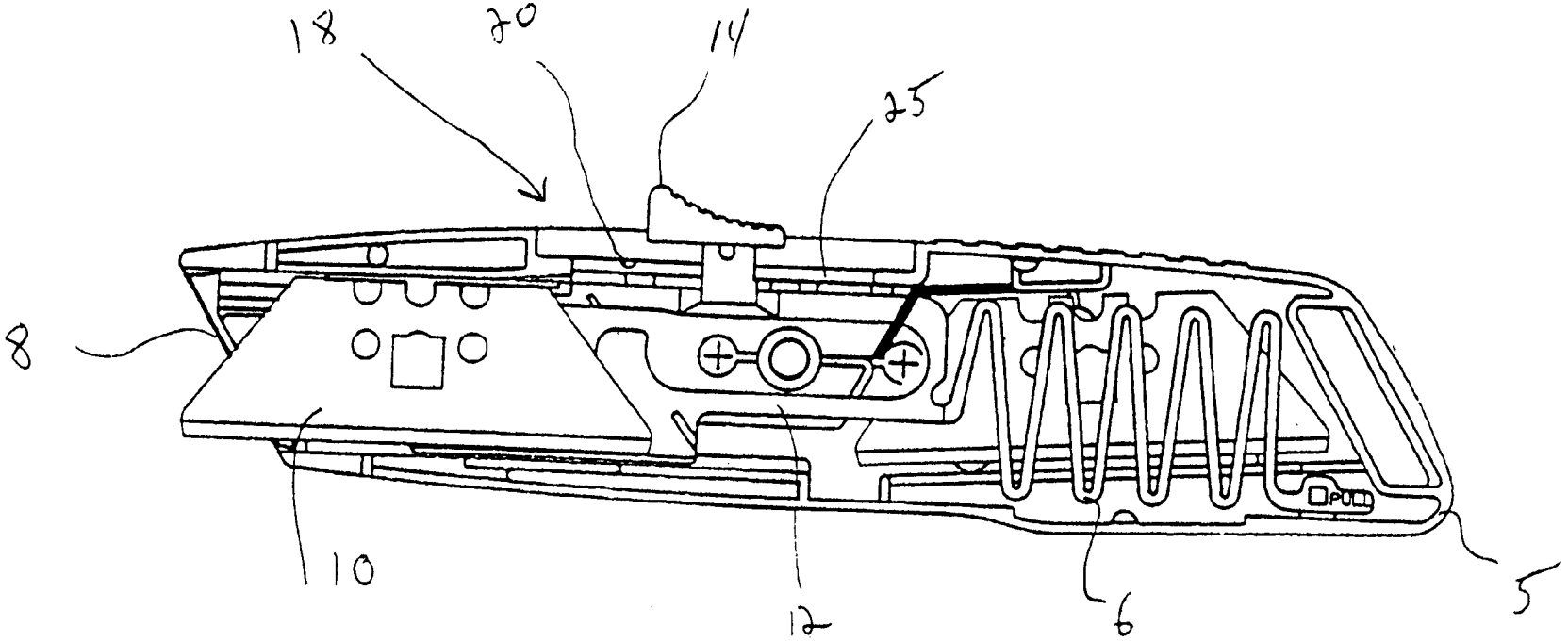
FIG. 5 is a left side view of the automatically retractable utility knife shown in FIG. 1 with the blade in a first extended position and the upper housing removed.
Figure 6:
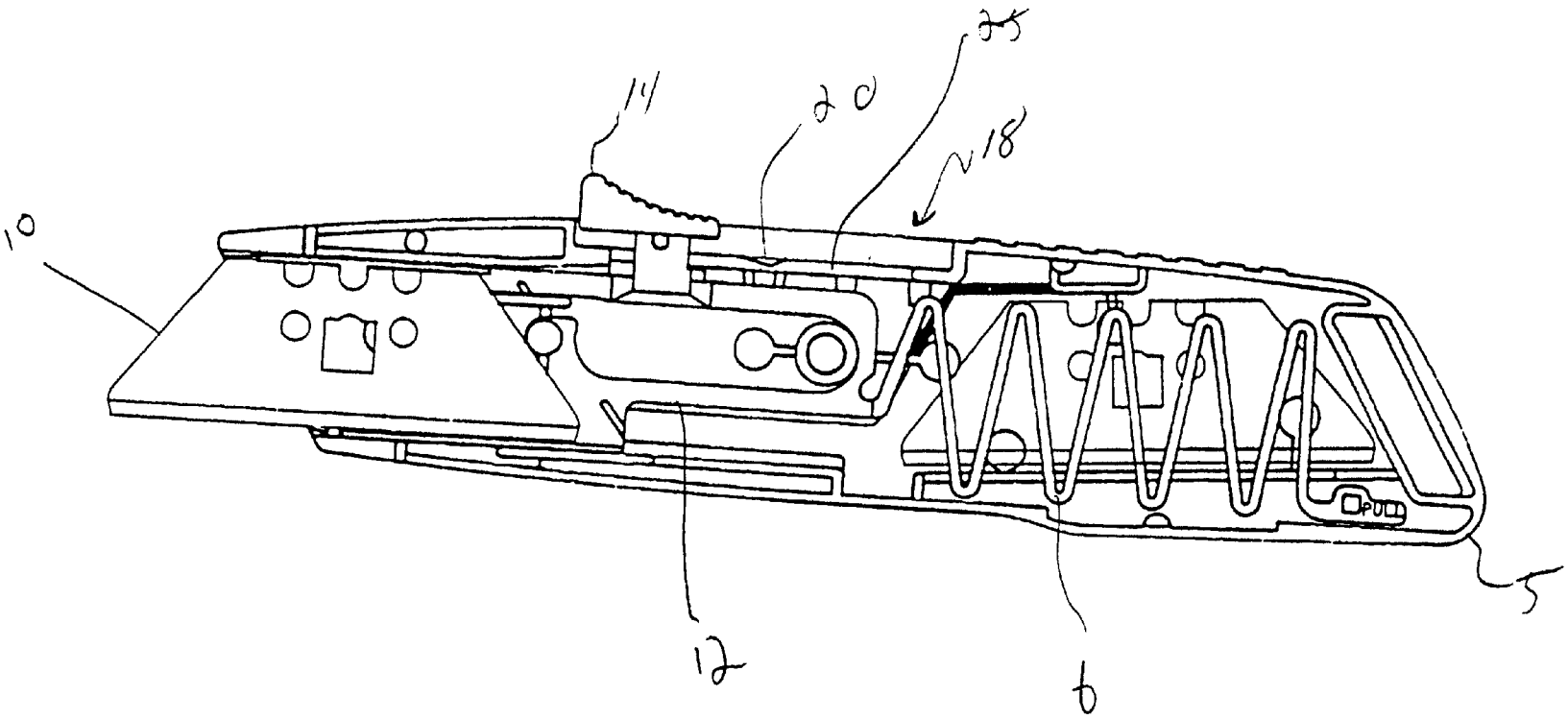
FIG. 6 is a top view of the automatically retractable utility knife shown in FIG. 1 with the blade in a second extended position and the upper housing removed.

Referring to FIGS. 4–6, utility knife 2 can be seen with upper housing portion 4 removed. Blade carrier 12 is preferably attached to a return spring 6 of any appropriate type, which automatically retracts blade 10 into the housing when no pressure is applied to thumb piece 14. If desired, blade carrier 12 may be integrally constructed with return spring 6, as shown in the aforementioned U.S. Pat. Nos. 6,058,607 and 5,813,121. Thumb piece 14 enables blade carrier 12, which is guided by rail 13, to be moved within the housing for extending and retracting blade 10. In a typical embodiment, a free end of return spring 6 is attached to lower housing 5 via aperture 33 through which a pin 16 on lower housing portion 5 extends.

FIGS. 5 and 6 show the automatically retractable utility knife with blade carrier 12 in a forward position and a fully extended position, respectively, exposing blade 10 from within the housing through the distal end 8 thereof. In each of these positions return spring 6 is under tension and provides a retraction force on blade carrier 12 toward the rear of lower housing portion 5. A force applied to thumb piece 14 causes blade carrier 12 to move toward distal end 8 of the housing, thereby placing return spring 6 under additional tension and exposing blade 10. Blade carrier 12 is guided by slot 18, support shoulders 24, 25, and guide rail 13 during movement within the housing. Once thumb piece 14 is released, return spring 6 automatically pulls blade carrier 12 toward the rear of the housing, thereby retracting blade 10 to a position completely within the housing.

Upper and lower housing portions 4 and 5 include at least one, and preferably a plurality of notches 20 located at various positions along each support shoulder 24 and 25. When upper and lower housing portions 4 and 5 are assembled, notches 20 on each support shoulder 24 and 25 are in substantial symmetrical alignment in pairs on each side and along the length of guide slot 18. As force is applied by the user on thumb piece 14 causing blade carrier 12 to move toward distal end 8 of the housing, thumb piece 14 slides along guide slot 18. While forward force is applied to thumb piece 14, downward force on support shoulder 24 and 25 is necessarily applied as well. Thumb piece 14 includes a protuberance 32 that is preferably adapted to frictionally engage each notch 20 during forward movement of thumb piece 14 with downward force applied thereto. As thumb piece 14 slides along guide slot 18, protuberance 32 becomes partly or fully depressed into each notch 20 as it passes the notch. This depression causes a partial locking of blade carrier 12 resulting from engagement of notch 20 and protuberance 32, which reduces the forward force required to offset the reverse tension applied to blade carrier 12 by return spring 6 during extension of blade 10. The sizes of notches 20 and protuberance 32 will determine the tension required to maintain the blade in the exposed position. The deeper protuberance 32 extends into notches 20, the less forward tension is required to maintain the blade in the exposed position. On the other hand, the greater the locking force of protuberance 32 with notches 20, the slower blade carrier 12 will retract the blade into the housing if pressure on thumb piece 14 is released. This poses a safety issue insofar as the blade poses a greater safety hazard the longer it is extended from the housing. As shown in FIGS. 1–6, a relatively shallow depth of notches 20 is preferred to reduce thumb piece pressure while still enabling fast retraction of the blade.

Figure 7A:
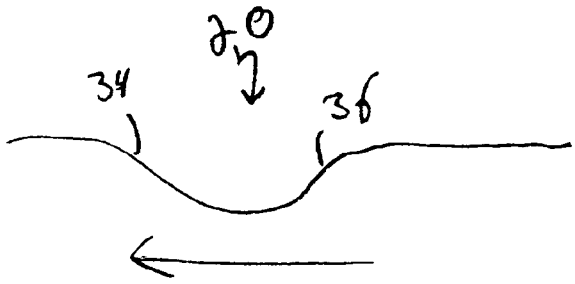
FIGS. 7A–7D are side views of various notches used in the automatically retractable utility knife of the invention.
Figure 7B:
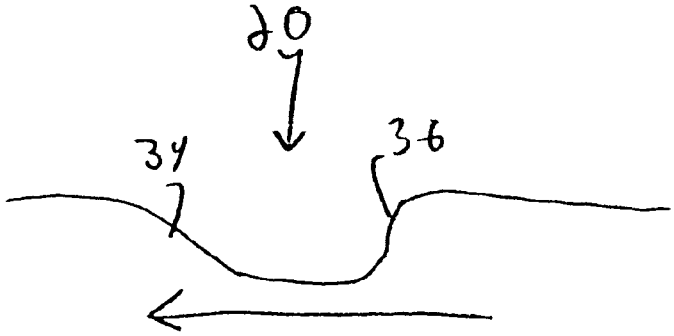
Figure 7C:
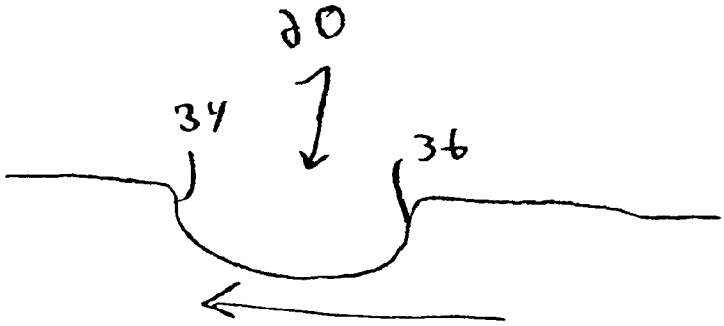
Figure 7D:
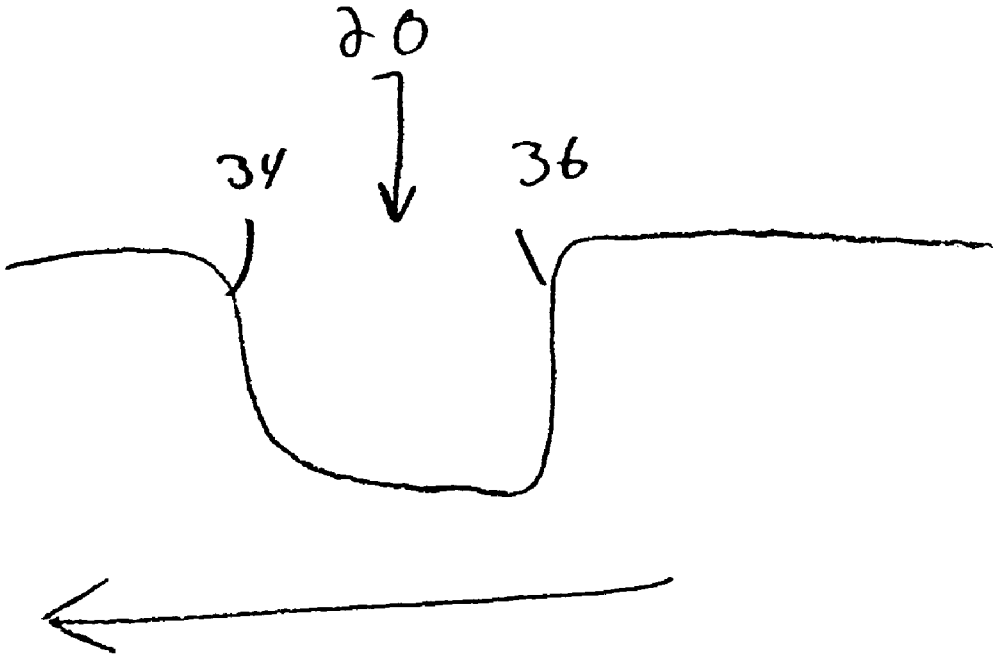

As shown in FIGS. 7A–7D, in addition to the depth of notches 20, the shape of notches 20 will also affect the force required to retract the blade. Referring to FIG. 7A, with the arrow indicating the direction of movement of the thumb piece (not shown) to expose the blade, in this embodiment, the shape of the forward direction ramping surface 34 and reverse direction ramping surface 36 of notch 20 are relatively shallow, thereby providing only limited impedance of forward and reverse movement of thumb piece 14, and limited reduction in force required to maintain thumb piece 14 at the desired position. In FIG. 7B, the shape of forward direction ramping surface 34 is relatively shallow, thereby providing only limited impedance of forward movement of thumb piece 14, and the shape of reverse direction ramping surface 36 is somewhat deeper, thereby providing greater reduction in the force required to maintain the blade exposed. In FIG. 7C, forward direction ramping surface 34 and reverse direction ramping surface 36 are somewhat deeper, thereby providing greater reduction in the force required to maintain the blade exposed, and an increase in the force required to further expose the blade. In FIG. 7D, notch 20 is relatively deep and the ramping surfaces are steeper, thereby better locking the blade in position, but reducing the retraction speed of the blade. Similarly, the shape of protuberance 32 may be altered to affect the locking force provided.

It will be appreciated that while the invention has been described with respect to an automatically retractable utility knife with the thumb piece on the narrow side of the housing, it is similarly applicable to other types of utility knives, such as those with the thumb piece on the wide side of the housing. More generally, although the present invention has been described with respect to certain embodiments and examples, variations exist that are within the scope of the invention as described in the following claims.

What is claimed is:

1. In an improved automatically retractable cutting device having (a) a housing comprising a guide slot, (b) a return spring within the housing, and (c) a blade carrier disposed within the housing and biased by the return spring, the blade carrier comprising a thumb piece extending through the guide slot for facilitating movement of the blade carrier in the housing to extend and retract a utility blade, the improvement comprising:

the housing comprising an upper portion and a lower portion adapted for assembly and a guide slot formed by the upper portion and lower portion, that portion of the guide slot on the upper portion comprising at least one notch and that portion of the guide slot on the lower portion comprising at least one notch; the notches of the upper and lower portions being substantially symmetrically aligned when the upper and lower portions of the housing are assembled, the thumb piece having a protuberance being adapted to at least partially engage the notch during movement of the thumb piece along the guide slot to enable the thumb piece to be held in position adjacent to the notch with reduced force.

2. The improved automatically retractable cutting device according to claim 1, wherein the protuberance is adapted to frictionally engage the notches.

3. The improved automatically retractable cutting device according to claim 2, wherein the notches comprise a forward direction ramping surface, whereby reduced force is required to prevent further blade extension.

4. The improved automatically retractable cutting device according to claim 2, wherein the notches comprise a reverse direction ramping surface, whereby reduced force is required to prevent blade retraction.

5. In an improved cutting device having (a) a housing comprising a guide slot, (b) a return spring within the housing, and (c) a blade carrier biased by the return spring, the blade carrier comprising a thumb piece extending through the guide slot for facilitating movement of the blade carrier in the housing to extend and retract a utility blade, the improvement comprising:

a housing having an upper portion and a lower portion adapted for assembly, the housing comprising a guide slot formed by the upper portion and lower portion, that portion of the guide slot on the upper portion comprising a plurality of notches and that portion of the guide slot on the lower portion comprising a plurality of notches; the plurality of notches on the upper portion and lower portion being substantially symmetrically aligned when the upper and lower portions of the housing are assembled, the thumb piece being adapted to frictionally engage each of the plurality of notches in order to decrease user force required to maintain extension of the utility blade.

6. A cutting device comprising:

a housing having an upper portion and a lower portion adapted for assembly, the housing comprising a guide slot formed by the upper portion and lower portion, that portion of the guide slot on the upper portion comprising a first set of notches and that portion of the guide slot on the lower portion comprising a second set of notches, the first and second set of notches being substantially symmetrically aligned when the upper and lower portions of the housing are assembled;

a return spring within the housing; and a blade carrier disposed within the housing, the blade carrier being biased by the return spring, the blade carrier comprising a thumb piece for facilitating movement of the blade carrier in the housing to extend and retract a utility blade, the thumb piece frictionally engaging at least one of the first and second sets of notches during extension of the blade.

7. The cutting device according to claim 6, further comprising a protuberance on the thumb piece, the protuberance being adapted to at least partially engage each notch during movement of the thumb piece.

8. The cutting device according to claim 7 wherein each of said notches comprise a ramp at an angle of less than ninety degrees.

9. The cutting device according to claim 8 wherein said ramps comprise forward direction ramping surfaces.

10. The cutting device according to claim 8 wherein said ramps comprise reverse direction ramping surfaces.

11. The improved cutting device according to claim 5, further comprising a protuberance on the thumb piece, the protuberance at least partially frictionally engagable with the notches during movement of the thumb piece.

12. The improved cutting device according to claim 11 wherein each of said notches comprise a ramp at an angle of less than ninety degrees.

13. The cutting device according to claim 12 wherein said ramps comprise forward direction ramping surfaces.

14. The cutting device according to claim 12 wherein said ramps comprise reverse direction ramping surfaces.

15. A cutting device comprising:

a housing having an upper portion and a lower portion adapted for assembly, the housing comprising a guide slot formed by the upper portion and lower portion, that portion of the guide slot on the upper portion comprising at least one notch and that portion of the guide slot on the lower portion comprising at least one notch, the notches of the upper and lower portions being substantially symmetrically aligned when the upper and lower portions of the housing are assembled;

an automatic retraction means within the housing; and a blade carrier disposed within the housing, the blade carrier being biased by the automatic retraction means, the blade carrier comprising a thumb piece for facilitating movement of the blade carrier in the housing to extend and retract a utility blade, the thumb piece frictionally engaging at least one of the notches during the extension of the blade.

16. The cutting device according to claim 15 further comprising a protuberance on the thumb piece, the protuberance being adapted to at least partially engage the notches during movement of the thumb piece.

17. The cutting device according to claim 16 wherein the notches comprise a ramp at an angle of less than ninety degrees.

18. The cutting device according to claim 17 wherein said ramp comprises a forward direction ramping surface.

19. The cutting device according to claim 17 wherein said ramp comprises a reverse direction ramping surface.

20. The cutting device according to claim 17 wherein said notches comprise a forward and reverse direction ramping surface.

* * * * *